US008141720B2

(12) United States Patent
Kellogg et al.

(10) Patent No.: US 8,141,720 B2
(45) Date of Patent: Mar. 27, 2012

(54) SADDLE RACK

(76) Inventors: Jeffrey Kellogg, Tama, IA (US); Paula M. Kellogg, Tama, IA (US)

( * ) Notice: Subject to any disclaimer, the term of this patent is extended or adjusted under 35 U.S.C. 154(b) by 528 days.

(21) Appl. No.: 12/012,914

(22) Filed: Feb. 5, 2008

(65) Prior Publication Data

US 2009/0194495 A1 Aug. 6, 2009

(51) Int. Cl.
*A47F 7/00* (2006.01)

(52) U.S. Cl. ..... 211/85.11

(58) Field of Classification Search ..... 211/85.11, 211/87.01, 94.01; D6/566; D30/143; 248/309.1, 248/222.51
See application file for complete search history.

(56) References Cited

U.S. PATENT DOCUMENTS

| | | | | | |
|---|---|---|---|---|---|
| 2,760,746 | A | * | 8/1956 | Botolfsen | 248/222.51 |
| 3,305,101 | A | * | 2/1967 | Mills | 211/106.01 |
| 3,780,971 | A | * | 12/1973 | De Filipps | 248/309.1 |
| D277,989 | S | * | 3/1985 | Wakat | D30/143 |
| D279,829 | S | * | 7/1985 | Bartholomew | D30/143 |
| 4,541,535 | A | * | 9/1985 | Bartholomew | 211/96 |
| D294,753 | S | * | 3/1988 | Otterbein | D30/143 |
| 5,050,744 | A | * | 9/1991 | Floyd | 211/85.11 |
| 5,101,985 | A | * | 4/1992 | Pasban-Dowlatshahi | 211/85.11 |
| 5,274,986 | A | * | 1/1994 | Gonzales | 54/44.1 |
| D378,448 | S | * | 3/1997 | Billings | D30/143 |
| D416,157 | S | * | 11/1999 | Akins | D6/566 |
| 6,189,706 | B1 | * | 2/2001 | Akins | 211/87.01 |
| 6,206,207 | B1 | * | 3/2001 | Kelley | 211/85.11 |
| 6,272,817 | B1 | * | 8/2001 | Further | 54/44.1 |
| 6,766,913 | B2 | * | 7/2004 | Steen et al. | 211/85.11 |
| D515,877 | S | * | 2/2006 | Czepowicz et al. | D7/619.1 |
| 7,028,854 | B1 | * | 4/2006 | Londrico | 211/89.01 |
| 7,168,666 | B2 | * | 1/2007 | Tucker | 248/150 |
| 7,255,235 | B1 | * | 8/2007 | Vry et al. | 211/85.11 |
| D569,638 | S | * | 5/2008 | Ballard et al. | D6/368 |
| 2002/0185830 | A1 | * | 12/2002 | Oliver | 280/47.24 |
| 2003/0051447 | A1 | * | 3/2003 | Bruce | 54/44.1 |
| 2003/0221328 | A1 | * | 12/2003 | Ferrand | 33/561.1 |
| 2004/0135041 | A1 | * | 7/2004 | Tucker | 248/150 |
| 2004/0182803 | A1 | * | 9/2004 | Lay et al. | 211/85.11 |
| 2006/0173367 | A1 | * | 8/2006 | Stuart et al. | 600/508 |
| 2007/0051077 | A1 | * | 3/2007 | Fennelly | 54/66 |
| 2007/0158285 | A1 | * | 7/2007 | Mann et al. | 211/85.11 |
| 2007/0187345 | A1 | * | 8/2007 | Hought | 211/85.11 |
| 2008/0210648 | A1 | * | 9/2008 | Davis | 211/41.3 |

* cited by examiner

*Primary Examiner* — Sarah Purol
(74) *Attorney, Agent, or Firm* — Brett Trout

(57) ABSTRACT

A saddle rack is provided with a resilient frame and means for biasing the frame to a desired arcuate shape. The saddle rack includes a retainer that allows the saddle rack to be coupled to a wall bracket for use and easily removed when not in use. The saddle rack includes a curved shape and venting to allow a saddle to properly dry without becoming damaged or disfigured during storage.

7 Claims, 7 Drawing Sheets

SADDLE RACK

BACKGROUND OF THE INVENTION

1. Field of the Invention

The present invention relates in general to a saddle rack and, more particularly, to a saddle rack which reduces undesirable distortion of the saddle and maintains the saddle off the ground.

2. Description of the Prior Art

Modern western saddles are often constructed of leather formed around a sturdy frame, often called a "tree." When the leather becomes soaked with sweat it may become deformed if the saddle is not stored and dried in a manner designed to maintain its shape. If the leather dries in a deformed manner, the saddle may have an irregular surface which can cause pressure points on the back of a horse or other animal upon which the saddle is secured.

It is known in the art to store saddles on the ground or over stall dividers, sawhorses, fences or the like. One drawback associated with prior art saddle storage means is the tendency of such storage means to undesirably deform the saddle. During use, a saddle may become moist with sweat from the animal upon which it is placed. The sweat may cause the saddle to become more malleable. When placed over a fence or on the ground, the weight of the saddle combined with the moisture causes the saddle to deform. As the saddle dries, the saddle may stiffen in the deformed shape. It would, therefore, be desirable to position the saddle upon a saddle rack which maintained the desired configuration of the saddle.

While it is known in the art to provide decorative saddle racks, such racks are expensive, heavy and often do not allow adequate ventilation to allow the perspiration to escape from the saddle. Accordingly, when placed on such a decorative rack, the perspiration may cause mold which may damage either the decorative rack or the saddle. Another drawback associated with such prior art racks is that the weight, cost and inability of the racks to weather the elements often prevents such decorative saddle racks from being used in a barn or other work environment.

While it is known in the art to provide metal saddle racks, such as that described in U.S. Pat. No. 4,541,535, and while such saddle racks allow for a substantial amount of venting of the saddle during storage, such racks support the saddles along an undesirably small number of locations. Some saddles are often provided with a fleece lining under the tree which serves as padding to reduce discomfort on the back of the horse. Placing the saddle on a device, such as a wire rack, which only supports the saddle in a limited number of places may cause the fleece to rub off of the saddle. Loss of fleece may cause rubbing and abrasion on the animal at the places where the fleece is missing. Although such prior art saddle racks are often better than stall dividers or fences, the saddle racks still allow for deformation of the saddle when placed thereon. It would, therefore, be desirable to provide a saddle rack which supported a saddle over a large area.

Accordingly, it would be desirable to provide a low cost, lightweight saddle rack which provides for full support of a saddle during storage while allowing for adequate ventilation as the saddle dries. It would also be desirable to provide a saddle rack which is adjustable and movable from one location to another. The difficulties encountered in the prior art discussed above are substantially eliminated by the present invention.

SUMMARY OF THE INVENTION

In an advantage provided by this invention, a saddle rack is provided which is of a low cost manufacture.

Advantageously, the present invention provides a saddle rack which is adjustable.

Advantageously, the present invention provides a saddle rack which reduces deformation of a saddle during storage.

Advantageously, the present invention provides a saddle rack which is removable.

Advantageously, the present invention provides a saddle rack which is easy to maintain.

Advantageously, the present invention provides a saddle rack which provides for adequate venting during storage of a saddle.

In an advantage provided by this invention, a saddle rack is provided having a resilient frame and means for biasing the frame toward an arcuate shape. Means are also provided for securing the frame to a wall. In the preferred embodiment, a mount is secured to the wall and a linkage is provided releasably securing the curved frame to the mount. The frame is preferably provided with a plurality of vents to allow the saddle to dry during storage.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
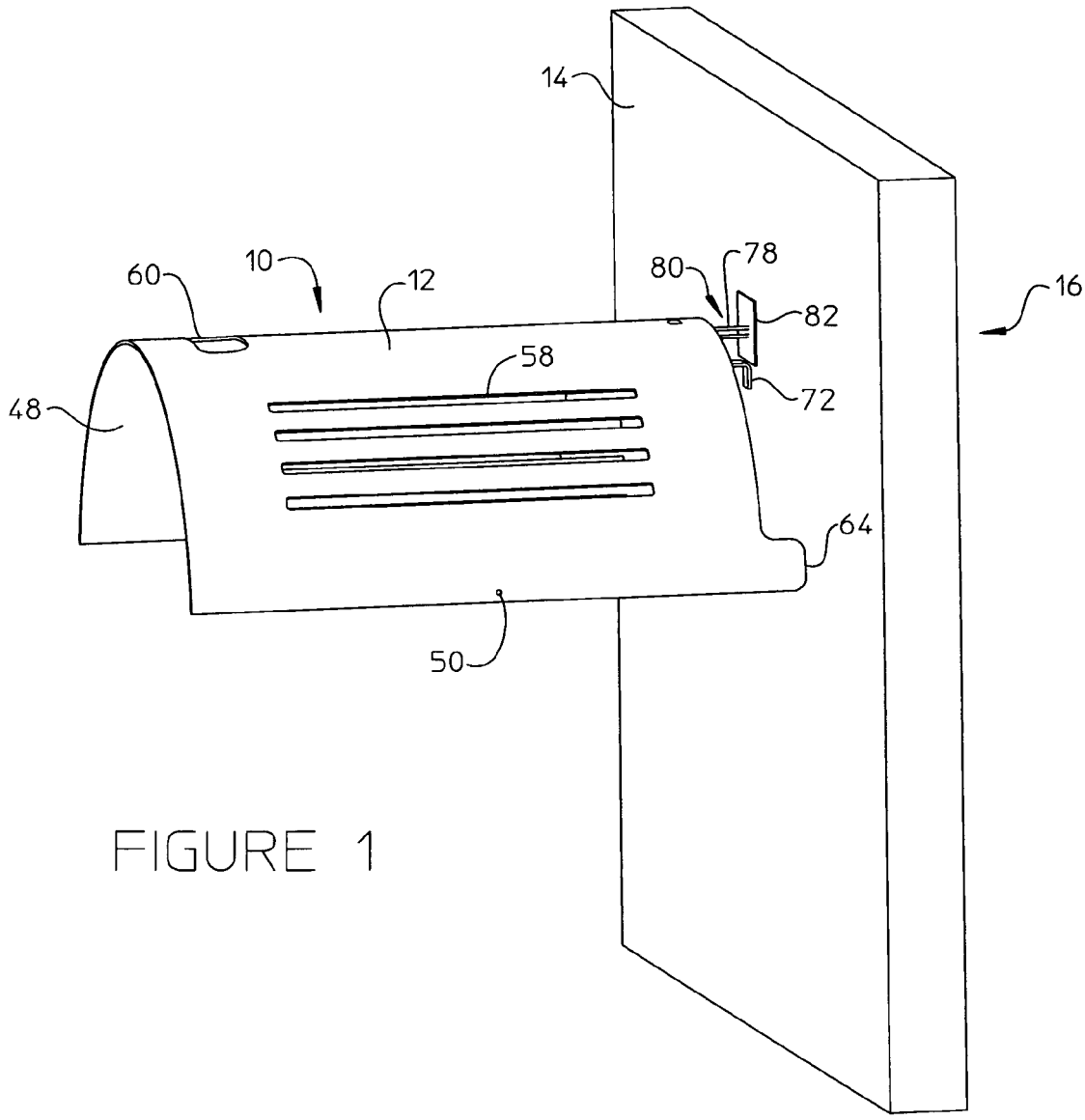
FIG. 1 illustrates a side perspective view of the saddle rack of the present invention coupled to a wall.

The present invention relates to a saddle rack shown generally as (10) in FIG. 1. The saddle rack includes a resilient frame (12) coupled to a wall (14). The wall (14) may be part of a barn (16), trailer (not shown), or any other desired location for storage of a saddle (18). (FIGS. 1-2).

As shown in FIG. 1, while the frame (12) may be constructed of any desired material, in the preferred embodiment the frame (12) is constructed of thin, bendable aluminum, having a thickness of between 0.05 and 0.5 inches, more preferably between 0.08 and 0.2 inches, and most preferably 0.12 inches in thickness. In the preferred embodiment, the frame (12) is constructed of bendable aluminum to prevent the frame (12) from rusting, and to allow the frame (12) to be lightweight and adjustable. The saddle rack (10) is preferably less than fifteen kilograms, more preferably less than ten kilograms, and most preferably, less than five kilograms.

Figure 2:
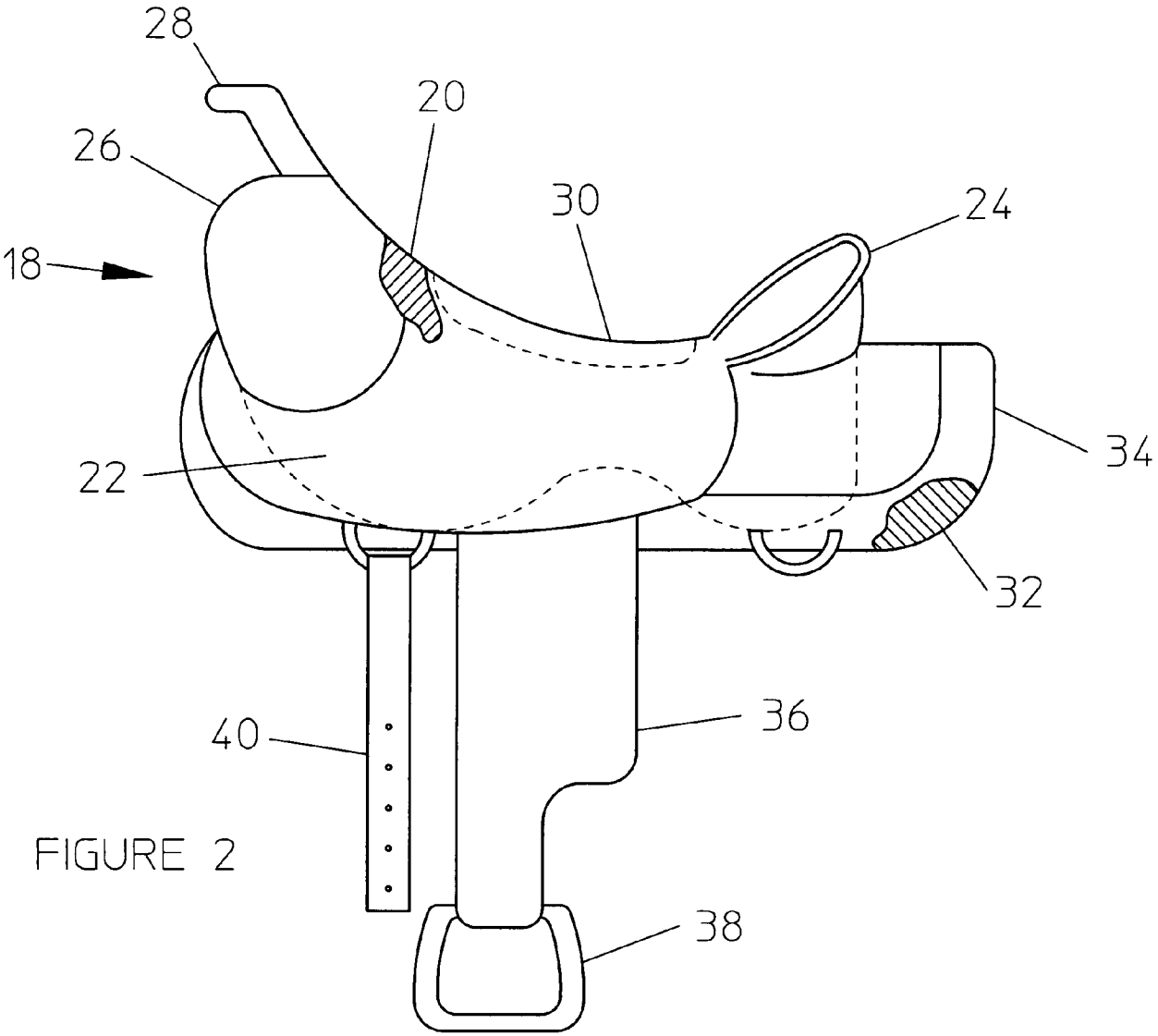
FIG. 2 illustrates a side elevation in partial cutaway of a saddle used in association with the saddle rack of the present invention.

As shown in FIG. 2, the saddle (18) is constructed of a frame or tree (20) around which is provided a layer of leather (22). The tree (20) preferably defines a cantle (24) and a pommel (26) upon which is provided a horn (28). The portion of the tree (20) between the cantle (24) and pommel (26) defines the seat (30). Provided underneath the tree (20) are layered fabrics which may be constructed of leather, cotton or the like which include the rear jockey (32) and skirt (34). Depending from the tree (20) are fenders (36), preferably constructed of leather and secured to a pair of stirrups (38). A cinch (40) is secured to the tree (20).

Figure 3:
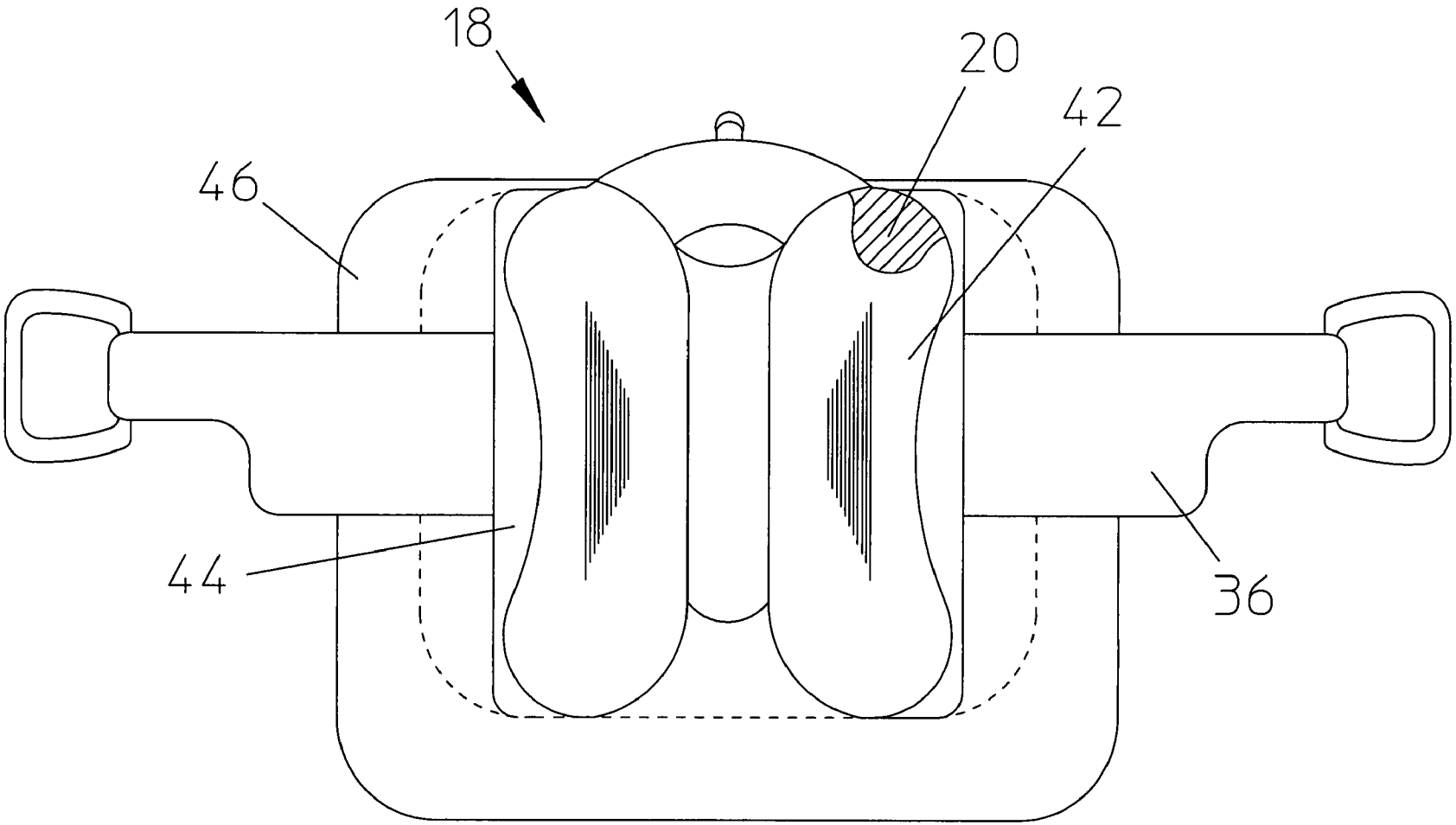
FIG. 3 illustrates a bottom plan view in partial cutaway of the saddle of FIG. 7.

As shown in FIGS. 2-3, the underside of the tree (20) is provided with padding (42), such as fleece, to prevent injury to the horse. The underside of the saddle (18) is also provided with a sweat flap (44) to protect the fenders (36) from sweat, dirt and other debris. The tree (20) and padding (42) are preferably constructed and configured to evenly distribute the weight of the saddle (18) and a rider (not shown) on an animal (not shown). If the saddle (18) is ridden for a sufficient amount of time to cause sweat from the animal to be deposited upon the padding (42), and the saddle (18) is not properly stored, the sweat can cause the leather (46) and padding (42) on the underside of the saddle (18) to deform. This deformation can prevent even distribution of weight on the animal and can cause pressure points and injury to the animal in some cases. Additionally, pressure points can cause undue wear and premature damage to the saddle (18).

While it is known in the art to provide the saddle (18) on wire racks or over a fence, such storage means do not properly maintain the correct configuration of the saddle (18) as the saddle (18) and the leather (22) and (46) thereon dries and contracts. Additionally, such storage mechanisms can cause imprints of the wire rack or fence to be left on the saddle (18), thereby causing worn padding (42) and pressure points, leading to injury to the animal and undue wear of the saddle (18).

Figure 4:
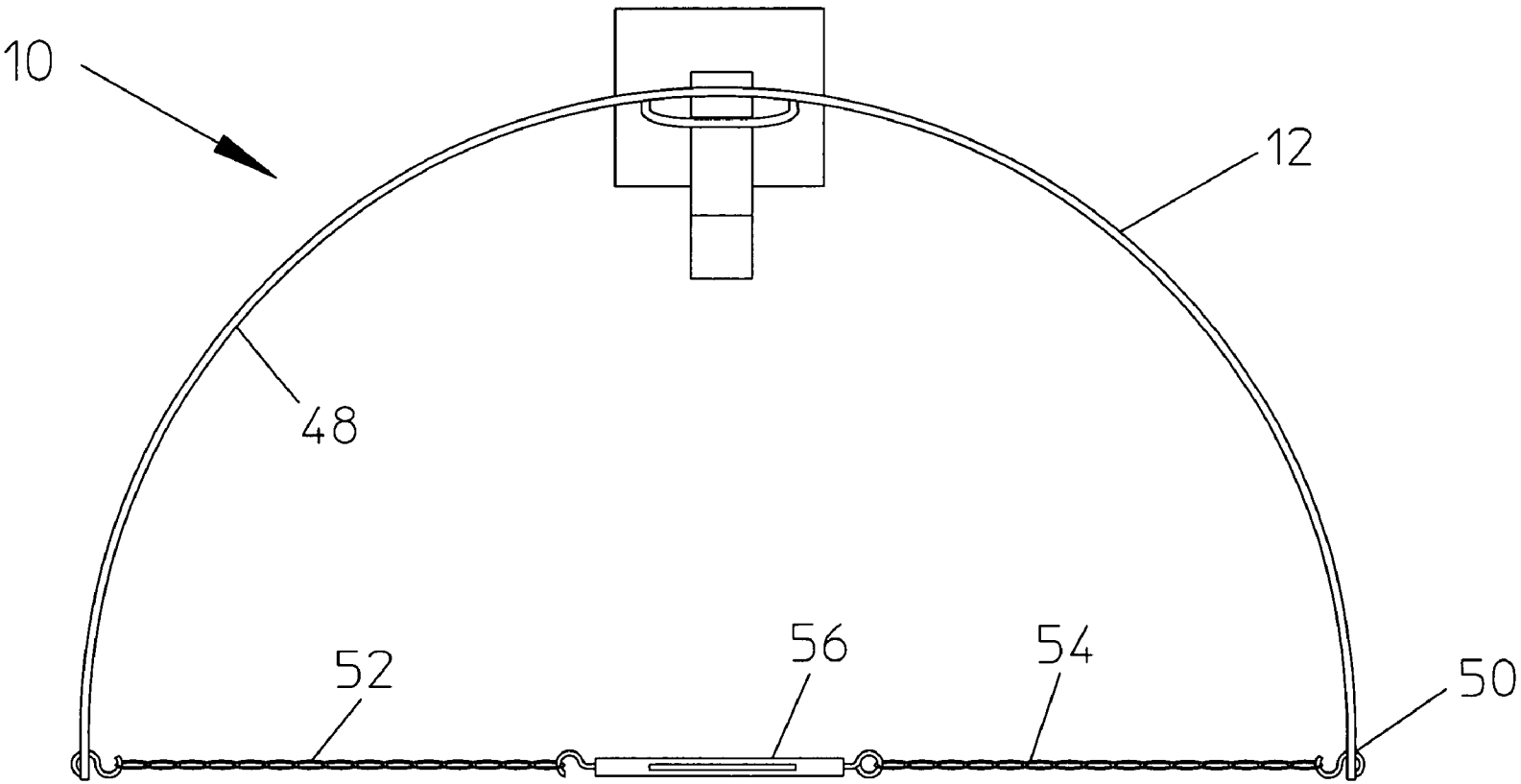
FIG. 4 illustrates a front elevation of the frame biased into an arcuate configuration.

As shown in FIG. 1, the saddle rack (10) is provided with a curvature (48) substantially equal to the curvature of the animal upon which the saddle (18) is to be provided. As shown in FIGS. 1 and 4, the frame (12) is provided with a pair of holes (50) (50) coupled to a pair of chains (52) and (54). The chains (52) and (54), in turn, are coupled to one another by a turnbuckle (56), such as those well known in the art. The chains (52) and (54), and turnbuckle (56), can be adjusted to change the curvature (48) of the frame (12) as desired to accommodate saddles (18) of various configurations.

Figure 5:
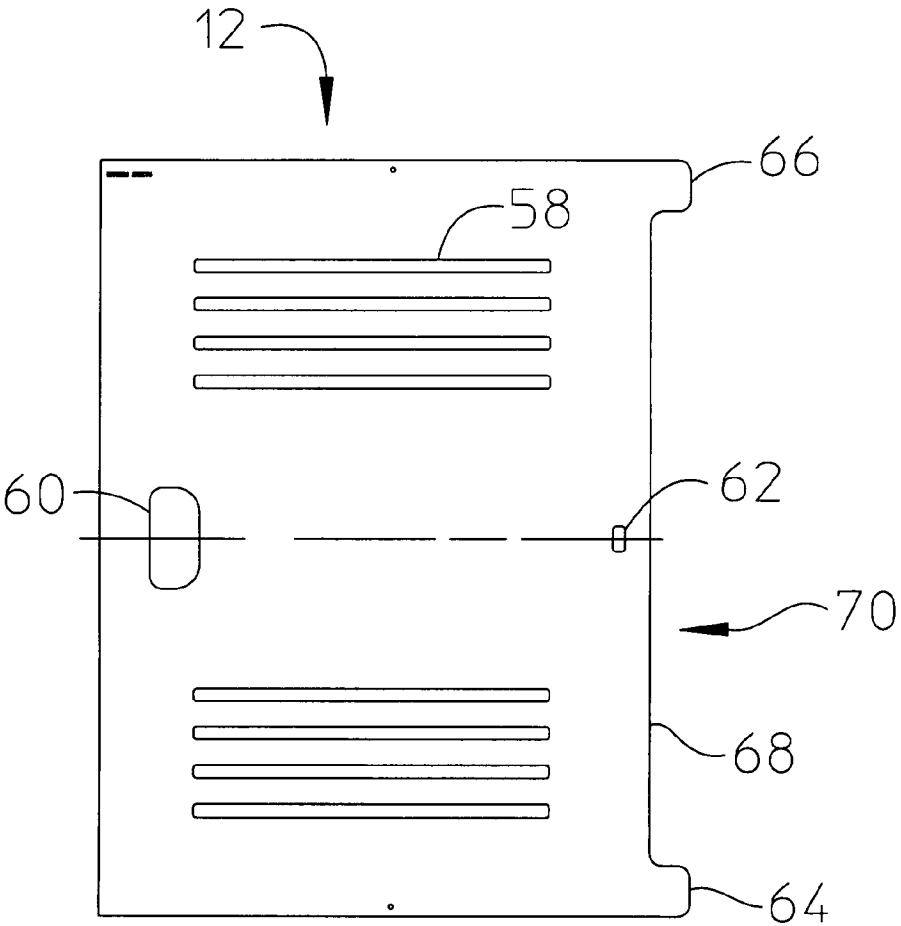
FIG. 5 illustrates a top plan view of the frame prior to biasing.

As shown in FIG. 5, the frame (12) is preferably cut from a flat sheet of resilient aluminum to form a plurality of vents (58), a handle (60), a retainer slot (62) and a pair of shoulders (64) and (66). The vents (58) may be of any desired number, configuration or orientation, and may, if desired, be provided in open communication with one another. The vents (58) are preferably designed to adequately ventilate the saddle (18) during storage to allow sweat and other moisture to evaporate therefrom while maintaining the configuration of the saddle (18). In the preferred embodiment, the retaining slot (62) is provided approximately one inch from the rear edge (68) of the frame (12), centered in relation thereto and provided with a width of one inch and a length of one-half inch. The dimensions of the retaining slot (62) may be adjusted as desired but is preferably located on the rearward half of the frame.

The shoulders (64) and (66) in the preferred embodiment are 2.0 inches in width and approximately 1.62 inches in length. The shoulders (64) and (66) may, of course, be of any suitable dimensions but preferably do not extend over the area (70) located directly rearward of the retainer slot (62).

Figure 6:
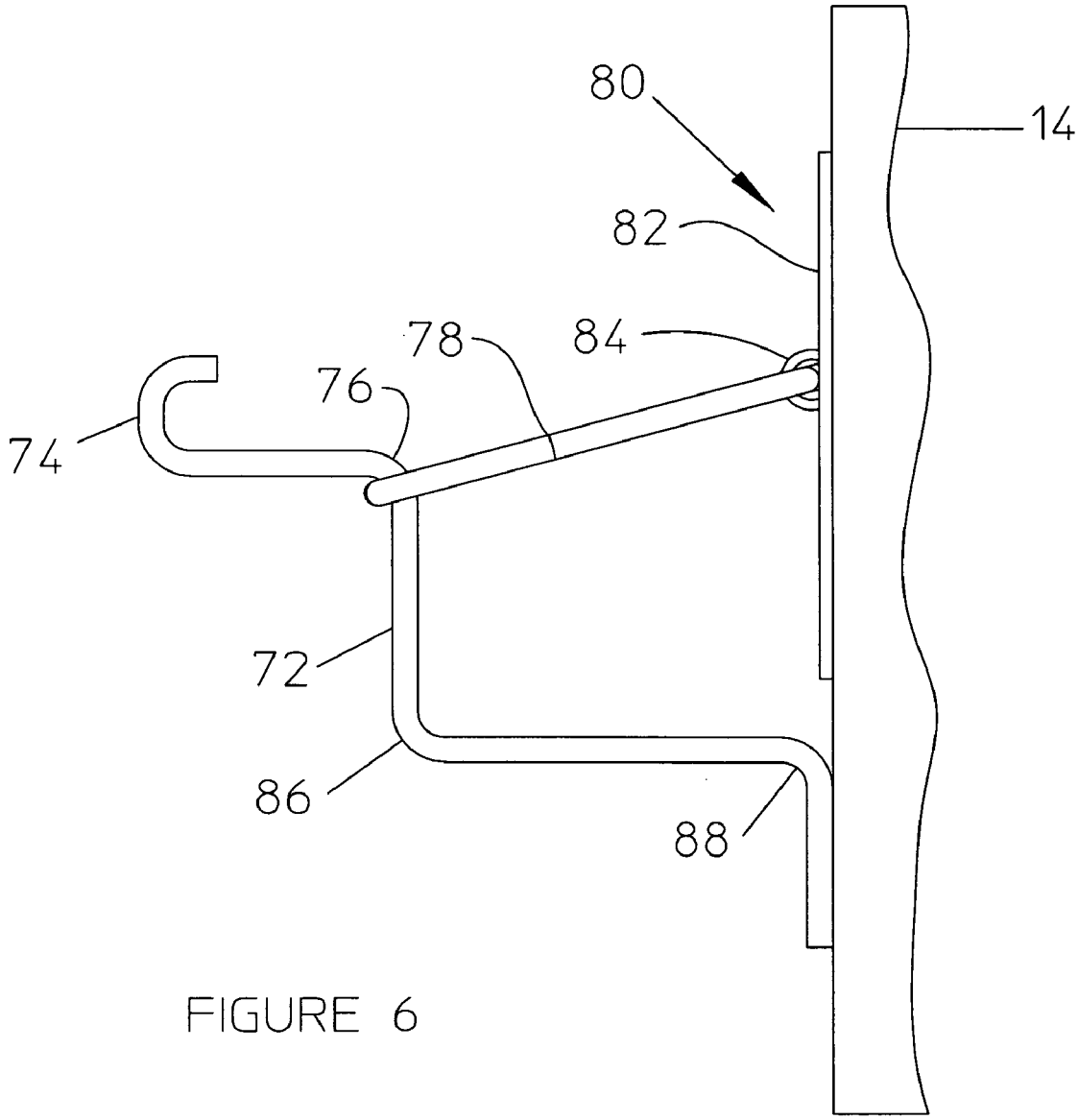
FIG. 6 illustrates a side elevation of the linkage connecting the frame to the wall bracket.
Figure 7:
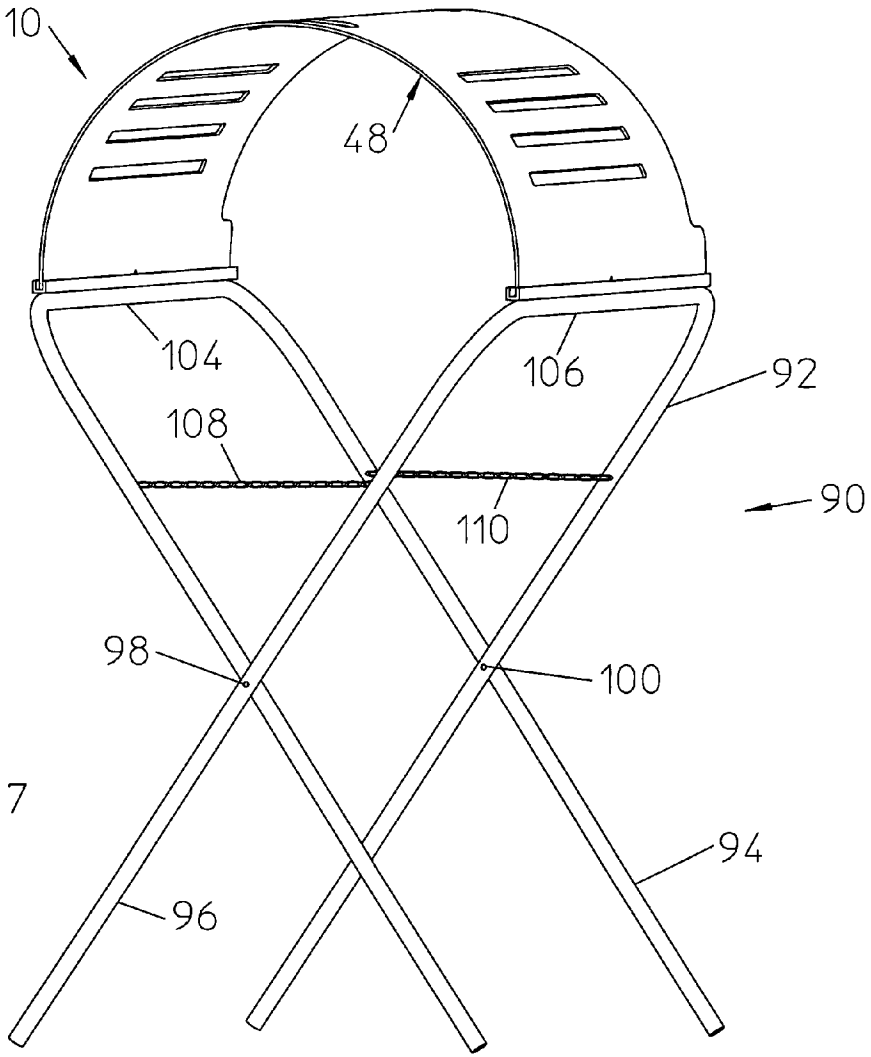
FIG. 7 illustrates a front perspective view of an alternative embodiment of the present invention mounting the frame to a saddle rack stand.

As shown in FIGS. 4 and 6, a retainer (72) is provided to secure the saddle rack (10) onto the wall (14). In the preferred embodiment, the retainer (72) is constructed of a 0.75 inch wide, 0.125 inch thick, strip of steel (FIGS. 4-6), bent to be provided with a hook (74) sufficient to retain the frame (12) through the retainer slot (62). The retainer (72) forms a curve (76) at the base of the hook (74) to receive the ring (78) of a bracket assembly (80). The bracket assembly (80) includes a plate (82) bolted or otherwise secured to the wall (14) and a sleeve (84) secured thereto. The trapezoidal ring (78) is provided within the sleeve (84) to create a hinged coupling of the ring (78) to the plate (82). As shown in FIG. 5, the ring (78) is received in the curve (76) of the retainer (72). Approximately an inch down from the curve (76) is another curve (86) which extends the retainer (72) back toward the wall (14). At the wall (14), approximately 1.5 inches away, the retainer (72) is provided with a downward curve (88) to abut the retainer (72) against the wall (14).

When it is desired to utilize the saddle rack (10) of the present invention, the bracket assembly (80) is positioned at a desired location on the wall (14), or at any other desired location. A turnbuckle (56) is then adjusted to create the desired curvature (48) for the saddle (18). The retainer (72) is provided through the ring (78) so that the ring (78) rests at the curve (76) of the retainer (72). The saddle rack (10) is then positioned over the retainer (72) so that the hook (74) of the retainer (72) is provided through the retainer slot (62). The saddle rack (10) may have to be tilted slightly upward to allow the hook (74) to engage the frame (12).

The shoulders (64) maintain the saddle rack (10) at a predetermined distance from the wall (14). Once the saddle rack (10) has been mounted, the saddle (18) may be placed thereon. The orientation of the frame (12) and vents (58) allow the saddle to properly dry, while maintaining its shape and preventing distortion. After storage is completed, the saddle (18) may be removed from the saddle rack (10) and the saddle rack (10) gripped by the handle to be removed from the retainer (72). Removal allows the space formerly occupied by the saddle rack (10) to be better utilized when the saddle rack (10) is not in use.

An alternative embodiment of the present invention is shown generally as (90) in FIG. 6. As shown in FIG. 6, the alternative embodiment (90) includes a rack (92). The rack (92) may be of any desired configuration, but is desirably designed to fold up and extend to support the saddle rack (10) when a wall or post is not available to locate the bracket assembly (80). As shown in FIG. 6, the rack (92) is of a standard folding configuration, with a first generally U-shaped assembly (94) pivotally coupled to a second generally U-shaped assembly (96) at pivot points (98) and (100), coupled by a spacer bar (102). The top bars (104) and (106) are preferably rounded to accommodate the curvature (48) of the saddle rack (10). In the preferred embodiment, the U-shaped assemblies (94) and (96) are coupled to one another by a pair of cords (108) and (110) to prevent the rack (92) from opening too wide and preventing the rack (92) from collapsing with the weight of the saddle rack (10) placed thereon. The rack (92) may be constructed of any suitable material and of any suitable dimensions, but is preferably foldable for ease of storage and transport.

Although the invention has been described with respect to a preferred embodiment thereof, it is to be understood that it is not to be so limited since changes and modifications can be made therein which are within the full, intended scope of this invention as defined by the appended claims.

What is claimed is:

1. A saddle rack comprising:

(a) a curved resilient frame, (b) an adjustable tensioner for biasing the frame toward a plurality of arcuate shapes, (c) a first shoulder coupled to the frame, (d) a second shoulder coupled to the frame, (e) a linkage having a forward end coupled to the frame, (f) a retainer coupled to the linkage at a predetermined location, and (g) wherein a rearward end of the linkage not in contact with the retainer extends below and rearward of the predetermined location.

2. The saddle rack of claim 1, wherein the frame has a surface area of at least 0.5 square meters.

3. The saddle rack of claim 2, wherein the frame weighs less than five kilograms.

4. The saddle rack of claim 1, wherein the frame weighs less than five kilograms.

5. The saddle rack of claim 1, wherein the adjustable tensioner is a turnbuckle.

6. The saddle rack of claim 1, wherein the frame defines a slot and wherein the linkage is releasably secured within the slot.

7. The saddle rack of claim 1, wherein the frame defines a plurality of vents.

* * * * *